United States Patent [19]

Larsson et al.

[11] B 4,078,715

[45] Mar. 14, 1978

[54] PACKING CONTAINER

[75] Inventors: Goran Larsson, Dalby; Lars Carlsson, Staffanstorp, both of Sweden

[73] Assignee: AB Ziristor, Lund, Sweden

[21] Appl. No.: 461,257

[22] Filed: Apr. 15, 1974

[44] Published under the second Trial Voluntary Protest Program on January 13, 1976 as document No. B 461,257.

[30] Foreign Application Priority Data

Apr. 24, 1973 Sweden ..... 7305711

[51] Int. Cl.[2] ..... B65D 5/72

[52] U.S. Cl. ..... 229/17 R; 229/DIG. 4

[58] Field of Search ..... 229/17 R, 17 G, 7 R, 229/DIG. 4

[56] References Cited

U.S. PATENT DOCUMENTS

| | | | |
|---|---|---|---|
| 1,288,132 | 12/1918 | Nagle | 229/6 |
| 2,523,246 | 9/1950 | Elliott et al. | 229/17 R X |
| 2,959,336 | 11/1960 | Mosse et al. | 229/17 G |
| 3,083,890 | 4/1963 | Ignell | 229/17 R X |
| 3,122,300 | 2/1964 | La Bombard | 229/Dig. 4 |
| 3,232,514 | 2/1966 | Swede et al. | 229/17 R |
| 3,498,524 | 3/1970 | Braum | 219/17 G X |
| 3,549,080 | 12/1970 | Gill | 229/17 R |
| 3,795,359 | 3/1974 | Rausing | 229/17 R X |
| 3,797,726 | 3/1974 | Reil | 229/17 R |
| 3,869,078 | 3/1975 | Braun | 229/17 R |

FOREIGN PATENT DOCUMENTS

| | | | |
|---|---|---|---|
| 1,247,747 | 10/1960 | France | 229/17 |

*Primary Examiner*—Davis T. Moorhead

*Attorney, Agent, or Firm*—Burns, Doane, Swecker & Mathis

[57] ABSTRACT

A packing container formed from a blank of thermoplastic coated paper or cardboard erected into a rectangular body and provided with a top closure established by a bellows folding technique which terminates in a folded-down fin that is held in place against the adjacent container wall.

2 Claims, 7 Drawing Figures

PACKING CONTAINER

Figure 1:
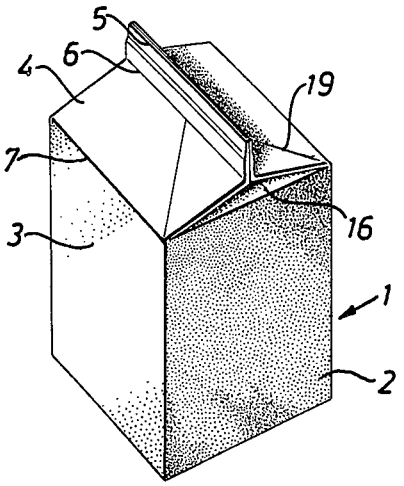

The present invention relates to a packing container of the type which is formed from a blank of thermoplastic-coated paper or cardboard to a tubular container body which comprises four sidewalls facing one another in pairs, an arbitrarily formed bottom portion and closure panels which, after the goods intended for packaging has been introduced into the container body, are intended to be closed in that the free edge portions of the closure panels are joined together by folding, e.g. a so-called bellows folding, and sealed, thus forming a sealing fin projecting from the upper end surface of the container.

In the packaging of liquid, powdery or granular products or the like, for example dairy products such as milk, buttermilk, yoghurt, cream etc, packing containers of the aforementioned type are used to an ever increasing extent. These containers are frequently manufactured from previously prepared blanks, which are formed to a tube, in the lower end of which a base closure is achieved and in the upper end of which a top closure is shaped and formed after the contents intended for packaging have been introduced into the tube. To facilitate inter alia a spacesaving stacking in transport and storage the packing containers are usually realized with a rectangular or square cross-section, and the top closure is shaped as a rule so that it comprises, or forms in itself, a pouring spout which facilitates the emptying of the package, the said pouring spout being located in the direct vicinity of or within one of the upper limiting edge lines of the sidewalls of the packing container. Moreover the thickness of the packing material of the packing container is dimensioned in such a manner that the packing containers retain the given shaped during normal transport and handling and that they can well absorb any stresses emanating from the contents.

Modern forms of distribution, however, demand that the packing containers should be shaped, or should be able to assume a shape, which is suitable for stacking and collection of the packing containers in units adapted for storage and transport. Thus it is becoming more common to use so-called roller pallets for the transport and storage of products of different kinds, whereby the individual packing containers for the products concerned are stacked in several layers on one another in the roller pallet. The stacking in the roller pallet takes place already on the occasion of the packaging and the collected packing containers are kept together thereafter in the roller pallet during transport and storage and until a consumer chooses the product in question, and in doing so separates a number of packing containers from the roller pallet.

For certain types of packages, however, special stacking sheets, insertions and the like have to be used in order to be able to use the so practical roller pallet. This is the case when the so-called "gable-top" packages are used, which are used inter alia to a large extent for the packaging of dairy products, and for which a plane suitable for stacking has to be created above the surface, composed of the ridge-like top-sides of the packing containers and not appropriate as a stacking plane. Previously in the stacking in several layers of such "gable-top" packages a strip formed of folded-up corrugated paper, plastic material or the like was placed in the V-shaped channel which is formed by the adjoining halves of the top-sides of two neighbouring rows of packing containers.

It has been found, however, that in a rational distribution with the use of for example so-called roller pallets there is strictly speaking no scope for a handling of such special devices as strips, stacking sheets, insertions and the like in spite of the fact that a multiplicity of such solutions has been presented.

In accordance with the present invention the problem has been solved by adapting instead the packing containers used here so, that they can be stacked and the invention is characterized in that the closure panels of the container are arranged so that they can be closed to provide the container with a substantially plane end surface, whereby, when the container is closed by a bellows folding, the container material projecting from the end surface is formed into a fin which extends mainly over the width of the end surface, whereas, when the container is closed by an edge joining of the closure panels the end closure is formed into a fin and into two double-walled, triangular lugs resulting from the folding and projecting from the container, the fin extending over the one side of the lugs and the whole end surface, and, when the container is closed by a combination of bellows folding and simple edge joining, the container material projecting from the end surface is formed into a fin and into one double-walled, triangular lug resulting from the folding and projecting from the container, the fin extending over the one side of the lug and the whole end surface, and that measures are taken to facilitate a folding down of the fin or for holding the fin in a foldeddown position against adjacent container sides.

A further charactertistic of the packing container in accordance with the invention consists in that each sidewall of the container body is provided with a folding line, which after closing of the container constitute edge lines between the sidewalls and the end face of the container and that two opposite sidewalls of the container body moreover have each at least two folding lines which run from respective ends of the edge folding line and converge against each other to the area of the fin formed in the closing of the container, the angle between these folding lines and the edge folding line being adapted so that the closure panels of the container body can be closed to form a substantially plane end face.

Packing containers of the type indicated here are usually made from a relatively rigid but still flexible material, whereby experience has shown that when the container is closed for example by a bellows folding, the end face will somewhat bulge outwards and the packing container in accordance with the invention therefore has the further characteristic that the end face is so dimensioned that when it is subjected to load, for example from another container being stacked or placed on the end face, the outwards bulge is pressed down so that a substantially plane end face is obtained on a level with the upper limit lines of the sidewalls.

The packing container thus need not in itself have a plane end face, but it must be shaped so that when the container or the end face is subjected to a load, the outwards bulging or otherwise uneven end face is pressed down so that the end face of the container will present a substantially plane surface, as a result of which the container becomes able to be stacked.

The packing containers here concerned also have a sealing fin projecting from the end face which, according to a further characteristic of the invention, is folded down against the end surface when it is subjected to a load, for example from another container being stacked or placed on the end surface. This folding down of the sealing fin may thus be carried out at the same time as a pressing down and planing out of an outwards bulging end face.

Figure 2:
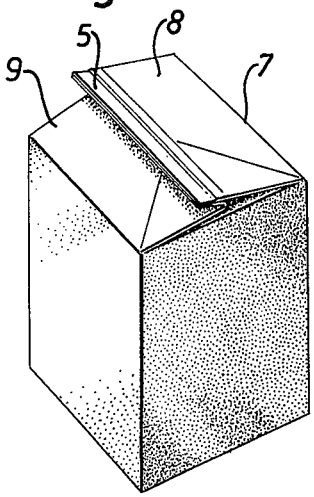
Figure 3:
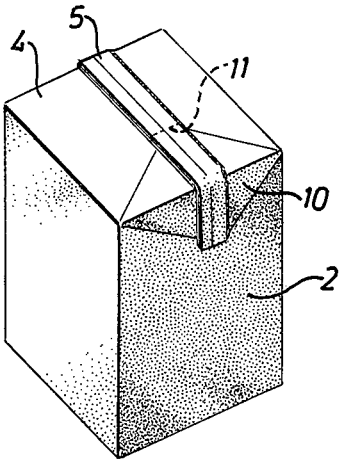
Figure 4:
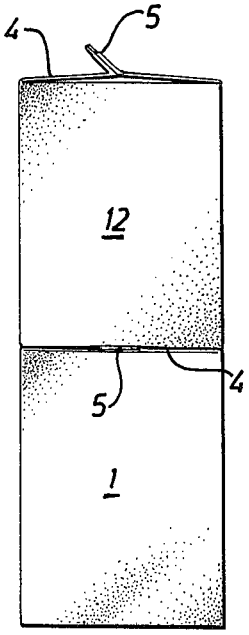
Figure 5:
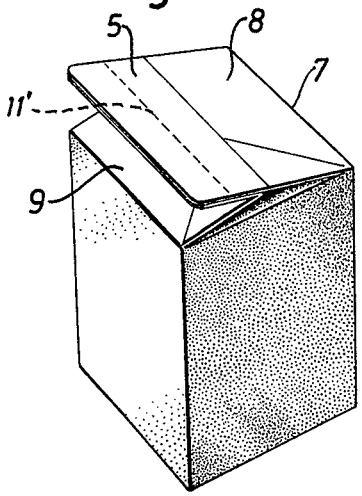
Figure 6:
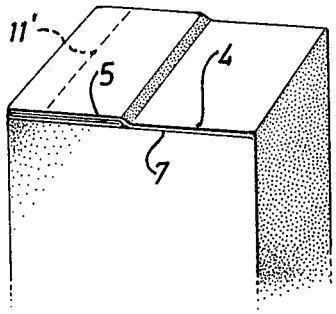
Figure 7:
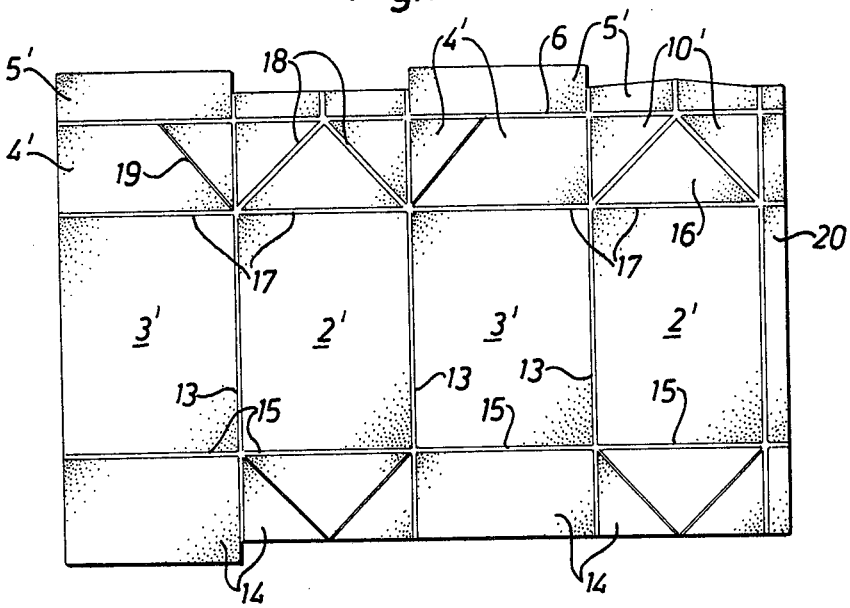

In the following description of the invention further characteristics of, and advantages resulting from, the invention will emerge, reference to be made to the enclosed schematic drawings, in which FIG. 1 shows a packing container in accordance with the invention with a sealing fin standing upright, FIG. 2 shows a packing container in accordancd with FIG. 1, in which measures have been taken to achieve a folding down of the fin, FIG. 3 shows a packing container in accordance with the invention with a somewhat differently shaped closure, FIG. 4 shows two packing containers in accordance with the invention stacked on top of one another, FIG. 5 shows an embodiment of the packing container in accordance with the invention, FIG. 6 shows a sideview of the packing container shown in FIG. 5, and FIG. 7 shows a packing blank for a packing container in accordance with the invention.

The packing container shown in FIG. 1 may be manufactured from a packing material which consists of a relatively rigid paper or cardboard which is coated on both sides with at least one layer of a thermoplastic material. Furthermore the container wall may comprise a layer of a metal foil, for example an aluminium foil layer and further plastic material layers. The packing container 1 has a tubular container body with four sidewalls 2 and 3 facing one another in pairs, an arbitrarily formed base closure and a top closure, which in a filled and closed package consists of an end face 4, which is arranged in such a way that parts of the end closure flap, on opening of the package, may form a pouring spout. Over the end face 4 extends a sealing fin 5.

The packing containers are manufactured from a blank and an example of such a blank is shown in FIG. 7. The blank has a number of sidewall panels 2′ and 3′, which correspond to the sidewalls of the packing container. The panels are connected to one another by crease lines 13 which facilitate the conversion of the blank to a tubular container body. The blank also has base-forming panels 14 which are connected together by crease lines, and via other crease lines 15 are joined together with the sidewall panels 2′, 3′. Furthermore the blank includes top-closure forming panels 4′, 5′, 10′ and 16 which are likewise interconnected by crease lines and are joined by means of other crease lines 17 to the sidewall panels 2′, 3′. The top-closure panels 4′, 5′, 10′ and 16, besides having to cover the opening of the tubular container body in the top part, are also intended for the forming of a pouring spout when the packing container is opened, through which pouring spout the contents of the package may be distributed in a well collected, straight forwards directed jet. For this purpose the panel 4′ has special crease lines 19 in order to simplify the forming of the pouring spout. Moreover the top-closure panels have parts 5′ for the sealing of the package, and these parts extend along the free edge of the blank and are limited by the same and by a crease line 6 extending over the blank. When the tubular body is formed the side edges of the packing blank are joined in an overlap seal by the help of the panel 20 shown in FIG. 5.

The packing container in accordance with FIG. 1–4 has an end face 4 which substantially is arranged in a plane contained in the edge lines 7 of the sidewalls 2, 3. The plane form of the upper end face 4 is achieved by choosing the distance between the crease lines 17 and 6 of the container blank in such a manner that it corresponds to half the width of the sidewall panels 2′, 3′, whereby two opposite closure panels 4′ will cover the opening of the container when the same are folded down over the opening. In order to obtain the above-mentioned plane end face 4 the angle between crease lines 17 and 18 ought to be chosen so that the infoldable triangular panel 16, situated between the crease lines 18, may occupy a substantially horizontal position on a level with the upper edge-line 7 of the container, just as the triangular, fold-in connecting panel 10′, which in a bellows folded manner are folded in between the panels 16 and the panel 4′.

In another embodiment of the upper part of the container, and which can be seen from FIG. 3, a so-called bellows folding is not used for the closure of the opening of the container. Thus the free edge portions of the container body are joined together simply by a single folding together or a combination of bellows folding and single folding together. The container material projecting from the end face 4, beside being formed into a fin 5, is formed into either one or two double-walled triangular lugs 10 resulting from the folding and projecting from the container, which is or are folded down and fixed to the neighbouring side walls 2 of the container.

After the opening of the container has been closed, whether this is done by a single folding together, a bellows folding or a combination of these folding processes, and sealed by preferably a melting together of the surface material of the free edge portions 5′ of the container or parts thereof, measures have to be taken or arranged for in order that the now upright sealing fin 5 might be folded down so that a substantially plane end face of the container is obtained. If the closure of the container takes place by a single folding together or by a combination of bellows folding and single folding together, the double-walled triangular lug or lugs 10 is or are folded down against a sidewall 2 of the container, the sealing fin 5 being forced by this operation at the same time to a folded down position against the end face 4 of the container. No further measures are required in this case for holding the sealing fin 5 in a folded-down position. This does not exclude, however, the application at the same time of any of the following methods for the folding down of the fin.

Thus the sealing fin 5 can be brought into a folded down position when it is subjected to a load, whereby use can be made of the folding line 6 arranged for the formation of the fin to facilitate such a folding down. According to a special embodiment the lower edge of the fin has a crease line 6, facilitating a folding, only on the one side of the fin. For the formation of the fin the arrangement of crease lines 6 on both sides of the fin would probably be preferred. However, the crease line on the one side of the fin can be carried out for example with a harder crease than the other crease line, so that a guidance for the folding down of the fin is obtained.

Since the material in this type of packing container in most cases consists of a relatively stiff material, it is possible in accordance with another embodiment to design the container material between the crease line 6 arranged in the lower edge of the fin or the sealing region and the edge line 7 running parallel with the sealing region or the said crease line 6 somewhat longer than the container material which is situated between the crease line or sealing region arranged on the other side of the fin and in its lower edge and the edge line which is adjacent and also running parallel with the sealing region. In this manner the sealing fin 5 is forced to be at least somewhat folded down or inclined towards the end face 4 of the container, as can be seen from FIG. 4. The sealing fin 5 of a packing container 1 will then become wholly folded down against its end face when the container is subjected to a load from another packing container 12 stacked or placed on the end face of the first container.

Owing to the flexible properties of the packing material, the end face 4 of the container, especially when its opening is closed by a bellow folding, will after the sealing be somewhat outwards bulging and thus not lie completely level with the upper limiting edge lines 7 of the container. This outwards bulging is generally obtained, in spite of the packing material in the end face 4 being dimensioned so that it can only form a horizontal covering of the opening of the container. The outwards bulge, like the possibly somewhat projecting sealing fin 5, will however be pressed down to a plane which is level with the upper edge lines of the container when the same is subjected to a load from for example another container stacked onto the container.

To obtain a better position of the pouring spout in relation to the rest of the container after it has been opened for distribution, an intentional outwards bulge of the end face of the container may be formed, which design is especially advantageous when the container is closed by a bellows folding, whereby the end face 4 of the container is thus provided with a somewhat projecting "gable-top." This "gable-top" or bulging out of the end face must be small enough, however, still to allow the bulge to be readily pressed down level with the upper edge lines of the container when the same is subjected to a load for example from another container.

The sealing fin 5 can of course be folded down and sealed against the end face 4 by surface-melting together of the outer coatings of the container. Furthermore the sealing fin can be sealed against the end face by means of a melting glue of thermoplastic material. A suitable melting glue in this connection is one which has a relatively low crystallinity and which at room temperature consists of a solid substance and which is heated to a molten state and is applied to the container, the melting glue becoming effective during cooling. The melting glue may consist of an ethylene vinyl acetate copolymer with the possible addition of, for example resin, wax or paraffin.

To facilitate the opening of the package for distribution at least a part of the fin must first be lifted up before the actual breaking open of the container. This is particularly necessary when the pouring spout is formed in a closure of the container by means of a single folding together, which form of realization is shown in FIG. 3. The sealing fin 5 may here have a perforation or some other weakening or tearing line 11, which is arranged preferably transversely to the longitudinal direction of the fin. That part of the fin which afterwards is to constitute a part of the pouring spout can consequently be lifted up after a tearing in the weakening line, whilst the remaining part of the fin can remain folded against the end face 4 of the container.

Another method to force the fin 5 into a folded down position is shown in FIGS. 5 and 6, and in accordance with this method one of the panels 5', which is connected to the panel 4', is extended to its length. Said panel 5' is preferably extended so much that it will reach to or near to the edge line 7 of the upper end face 4. Consequently, the extended panel 5' will protrude over the front edge of the adjoining panel 5' and said protruding part being sealed to the underlying panel 4'. The extended part of panel 5' can preferably be connected to the remaining part of the panel by means of one or more perforation or weakening lines 11', by the help of which the protruding part of the panel 5' can be separated from the rest of the panel 5'. After the breaking of the perforation line or lines 11' the fin 5 is free to be folded to an upright position, mainly perpendicular to the upper end face 4 and thereafter the opening of the container can be done in a known manner by breaking the triangular panels 10' outwardly and backwardly and by forcing the triangular panel 16 forwards in order to form a pouring spout.

Modifications of the embodiments described and shown are possible without exceeding the scope of the concept of the invention. Thus the actual opening arrangement of the container may be designed in a number of ways, but when the container is closed by a bellows folding, the customary opening procedure for this is of course fully applicable. When the container is closed by a single folding together and the pouring spout is partly formed in the double-walled, triangular lug 10, the opening arrangement may be provided instead with tearing perforations, ripping thread or some other suitable element. Furthermore the end face 4 may have crease lines 19 to facilitate the formation of the pouring spout. The invention is thus not limited by the cases given as examples, but only by the following claims.

We claim:

1. In a rectangular package composed of a packaging material coated on both sides with at least one layer of a thermoplastic coating material, said package being of the type having a top closure including a fin formed by a face to face seal of the outer portions of two opposed top closure flaps of opposed walls and triangular folds of the two closure flaps of the other opposed walls, said top closure being capable under a load to lie flat in a substantially plane end face, the improvement comprising crease lines between the outer portions of the two opposed top closure flaps of the opposed walls which form the fin and the inner portions of said flaps, one of said crease lines having a harder crease than the other of said crease lines so that said sealed fin will normally lean at an acute angle to the vertical in a direction toward the harder crease line so as to facilitate forming the substantially plane end face when subjected to a load.

2. In a package as claimed in claim 1 wherein the two opposed top closure flaps which form the fin have a depth substantially equal to the width of said other opposed walls of the package so that when folded down the flap having the crease line of lesser crease will extend over the entire top closure of said package.

* * * * *